US006425740B1

(12) United States Patent
Jacobsen et al.

(10) Patent No.: US 6,425,740 B1
(45) Date of Patent: Jul. 30, 2002

(54) RESONATOR PUMPING SYSTEM

(75) Inventors: Stephen C. Jacobsen; Clark C. Davis, both of Salt Lake City, UT (US)

(73) Assignee: SARCOS, L.C., Salt Lake City, UT (US)

( * ) Notice: Subject to any disclaimer, the term of this patent is extended or adjusted under 35 U.S.C. 154(b) by 0 days.

(21) Appl. No.: 09/627,852

(22) Filed: Jul. 28, 2000

(51) Int. Cl.[7] ..... F04B 41/06
(52) U.S. Cl. ..... 417/2; 417/415
(58) Field of Search ..... 417/415, 416, 417/501, 490, 244, 413.3

(56) References Cited

U.S. PATENT DOCUMENTS 3,741,686 A 6/1973 Smith
4,370,101 A 1/1983 Vander Horst
4,412,786 A 11/1983 Perry

*Primary Examiner*—Charles G. Freay
*Assistant Examiner*—William H. Rodriguez
(74) *Attorney, Agent, or Firm*—Thorpe North & Western

(57) ABSTRACT

A resonator pump system includes a resonating structure configured for resonating, and a fluid pump coupled to and driven by the resonating structure. An energy source is operatively coupled to the resonating structure for maintaining resonance.

31 Claims, 4 Drawing Sheets

RESONATOR PUMPING SYSTEM

BACKGROUND OF THE INVENTION

1. The Field of the Invention

The present invention relates generally to a resonator pumping system, particularly useful as an accurate drug delivery system, and having a resonating structure coupled to a fluid pump for pumping fluid.

2. The Background Art

Many applications or situations require accurately pumping or metering relatively small quantities of fluid. For example, IV pumps have been developed to accurately meter or control medicament from an IV bladder to an IV needle for treating a patient. The intravenous administration of fluids to patients is a well-known medical procedure for, among other things, (i) providing life sustaining nutrients to patients whose digestive tracts are unable to function normally due to illness or injury, (ii) supplying antibiotics to treat a variety of serious infections, (iii) delivering analgesic drugs to patients suffering from acute or chronic pain, (iv) administering chemotherapy drugs to treat patients suffering from cancer, etc.

The intravenous administration of drugs frequently requires the use of an IV pump connected or built into a so-called IV administration set including, for example, a bottle of fluid to be administered and typically positioned upside down, a sterile plastic tubing set, and a pump for pumping fluid from the bottle through the IV set to the patient. Other mechanisms may be included to manually stop the flow of fluid to the IV feeding tube and possibly some monitoring devices.

Current IV pumps generally are of two basic types: electronic pumps and disposable non-electronic pumps. Although the electronic pumps have been significantly miniaturized and do include some disposable components, they are nevertheless generally high in cost, require frequent maintenance with continued use, and may be difficult for a layman to operate if, for example, self treatment is desired.

The disposable non-electric pumps generally consist of small elastomeric bags within a hard shell container, in which the bags are filled with IV solution under pressure. The pressure generated by the contraction of the elastomeric bag forces the IV solution through a fixed orifice at a constant flow rate into the patient's vein. Although these pumps are much less expensive than the electronic pumps and eliminate the need for maintenance (since they are discarded after every use), their drawbacks include the lack of monitoring capability, the lack of the ability to select different flow rates, limited fluid capacity, and still relatively high cost for a disposable product.

Disadvantages with many prior art IV pumps includes their relatively large size, complexity, and cost. Such IV pumps are typically bulky, complicated, and costly to produce and use.

OBJECTS AND SUMMARY OF THE INVENTION

It has been recognized that it would be advantageous to provide a pump system which would allow precise pumping or metering of fluids, such as medicament, including IV fluids, and other application where the fluid is more concentrated, such as insulin, PCA, and chemotherapy. In addition, it has been recognized that it would be advantageous to provide such a pump system which is cost effective to produce and use, and which may be disposable. In addition, it has been recognized that it would be advantageous to provide such a pump system which is small and controllable.

The invention provides a resonator pump system including a resonating structure configured for resonating, and a fluid pump coupled to and driven by the resonating structure. The fluid pump preferably includes a cavity having a fluid inlet and a fluid outlet, and a piston movably disposed within the cavity and operatively coupled to the resonating structure. An energy source is operatively coupled to the resonating structure for maintaining resonant reciprocation.

In accordance with one aspect of the present invention, the resonating structure reciprocates at a relatively high frequency, such as between 200 Hz to 2 Khz, and the fluid pump is relatively small, having a cavity or piston diameter of between 100 to 1000 microns.

In accordance with another aspect of the present invention, the pump system includes a sensor for sensing the resonation of the resonating structure and producing a sensor signal. The energy source may include a driver which is responsive to the sensor signal for applying a force to the resonating structure to maintain the resonance. A controller may be coupled to the driver and the sensor for controlling the amplitude or frequency of the resonating structure.

In accordance with another aspect of the present invention, the fluid pump is mechanically coupled to a moving portion of the resonating structure by a transmission arm coupled to and between the resonating structure and the fluid pump. The transmission arm may be a flexible arm rigidly coupled to both the pump and the structure. Alternatively, the transmission arm may be a rigid arm pivotally coupled to both the pump and the structure.

In accordance with one embodiment of the present invention, the resonating structure includes a spring element coupled to a mass, and configured for linear motion with respect to the base.

In accordance with another embodiment of the present invention, the resonating structure includes an elongated and flexible spring element coupled to a mass, and configured for arcuate motion with respect to the base.

In accordance with another embodiment of the present invention, the resonating structure includes a piezoelectric element configured for bending under an applied electric field.

In accordance with another embodiment of the present invention, the fluid pump comprises first and second fluid pumps on opposite sides of the resonating structure to achieve a substantially constant fluid flow.

In accordance with another embodiment of the present invention, the fluid pump includes a cavity disposed proximate the spring element, and a piston directly connected to the spring element.

In accordance with another embodiment of the present invention, the system includes a spool valve fluidly coupled to the fluid pump, and a second resonating structure coupled to the spool valve, and configured for resonating 90 degrees out of phase from the first resonating structure.

In accordance with another aspect of the present invention, a plurality of resonating structures are coupled to a plurality of fluid pumps with the fluid pumps being coupled in series to increase pressure. In addition, fluid pumps may be coupled in parallel to increase flow.

In accordance with another embodiment of the present invention, the system may include first and second flat layers, and a third layer sandwiched between the first and second layers. The third layer is patterned with openings to form both the resonating structure and the fluid pump.

The fluid pump and resonating structure may be inserted into an IV line in order to pump or meter medicament to an IV needle.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
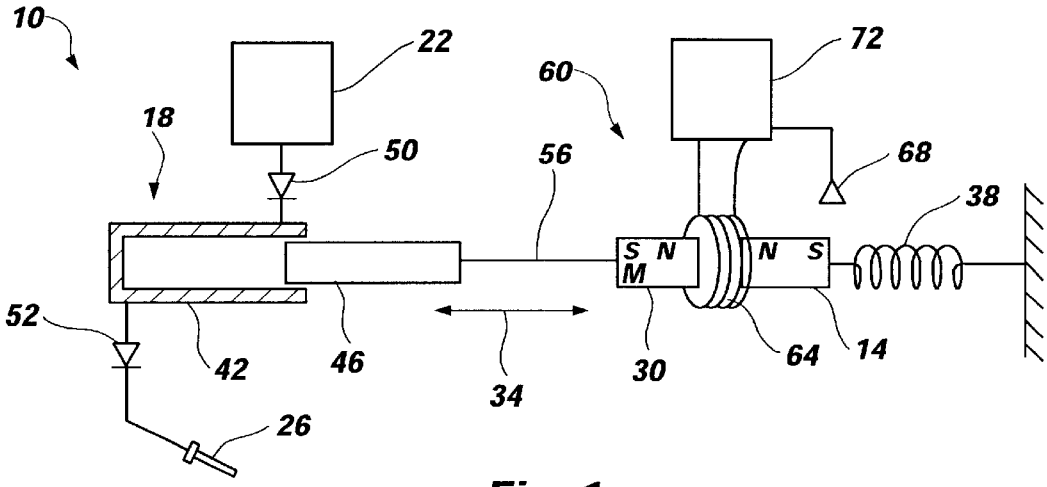
FIG. 1 is a schematic view of a first presently preferred embodiment of a resonator pump system in accordance with the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

As illustrated in FIGS. 1–8, various presently preferred embodiments of resonator pumping systems are shown in accordance with the present invention for pumping a fluid. The systems generally include a resonating structure 14 coupled to a fluid pump 18, which may take various different forms, as described in greater detail below. The resonating structure 14 may include a mass and spring element which alternate between kinetic and potential energy states, or between maximum and minimum kinetic and potential energies. Such resonating structures 14 may resonate or oscillate for extended periods of time, or continuously without any losses, such as friction.

Referring to FIG. 1, a first presently preferred embodiment of a resonator pump system, indicated generally at 10, is shown for pumping a fluid, such as a medicament, from a fluid reservoir or bladder 22, to a desired location, such as an IV needle 26. Thus, the resonator pumping systems maybe utilized to accurately pump or meter medicament, such as insulin for diabetics; chemotherapy fluids; etc.

The resonating structure 14 includes a moving body, member, or element 30 having a mass m. The resonating structure 14 or body 30 resonates or oscillates back and forth, as indicated by arrow 34, along a linear movement path. The resonating structure 14 also includes an energy storing and releasing system, such as a compression spring 38. The spring 38 compresses and extends to store and release energy. Thus, the body or mass 30, and spring 38, form the resonating structure 14 and resonate or oscillate 34. As the resonating structure 14 oscillates back and forth in a linear fashion, it moves from a position of greatest potential energy (and least kinetic energy) at the far left range of motion, through a position of greatest kinetic energy (and least potential energy) as it moves through its middle range of motion, to a position of greatest potential energy (and least kinetic energy) at the far right range of motion.

The fluid pump 18 may be a piston pump and include a cavity or tube 42, and a piston 46 slidably disposed within the cavity. The piston 46 moves back and forth in the cavity 42 to vary the volume or capacity of the cavity 42.

The cavity 42 includes a fluid inlet for allowing fluid into the cavity 42, and a fluid outlet for allowing fluid to exit the cavity 42. Inlet and outlet check valves 50 and 52 are located at the respective fluid inlet and outlet. Thus, the inlet check valve 50 allows unidirectional flow into the cavity 42 from the fluid reservoir 22, while preventing fluid flow back into the reservoir 22. Similarly, the outlet check valve 52 allows unidirectional flow out of the cavity 42 to the needle 26, while preventing fluid flow back into the cavity 42.

As the piston 46 moves out of the cavity 42, a vacuum (or pressure differential) is created which draws fluid through the inlet check valve 50 and into the cavity 42. As the piston 46 moves into the cavity 42, the piston 46 pushes (or again creates a pressure differential) which forces the fluid through the outlet check valve 52 and into the needle 26.

The fluid pump 18 or piston 46 is advantageously operatively coupled to the resonating structure 18. A transmission arm 56 is coupled to and extends between a moving portion of the resonating structure 14, or body 30, and the piston 46 of the pump 18. Thus, the oscillatory motion of the resonating structure 14 is transferred to the piston 46 to drive the pump 18.

As indicated above, resonating structures may resonate or oscillate for extended periods of time, or continually without losses. Such resonating structures typically experience losses, such as friction, which eventually cause the resonating structure to stop resonating. Thus, an energy source, indicated generally at 60, is operative coupled to the resonating structure 14 for maintaining the resonance, or oscillatory motion. The energy source 60 may include a driver 64, such as an electromagnet, which exerts a force on the resonating structure 14, of body 30.

In addition, a sensor 68 may be positioned to sense the resonation or oscillatory motion of the resonating structure 18 or body 30 and produce a sensor signal. A controller 72 is coupled to the driver 64 and is responsive to the sensor signal for controlling the driver 64, and thus maintaining or controlling the amplitude and frequency of the resonation.

Figure 2:
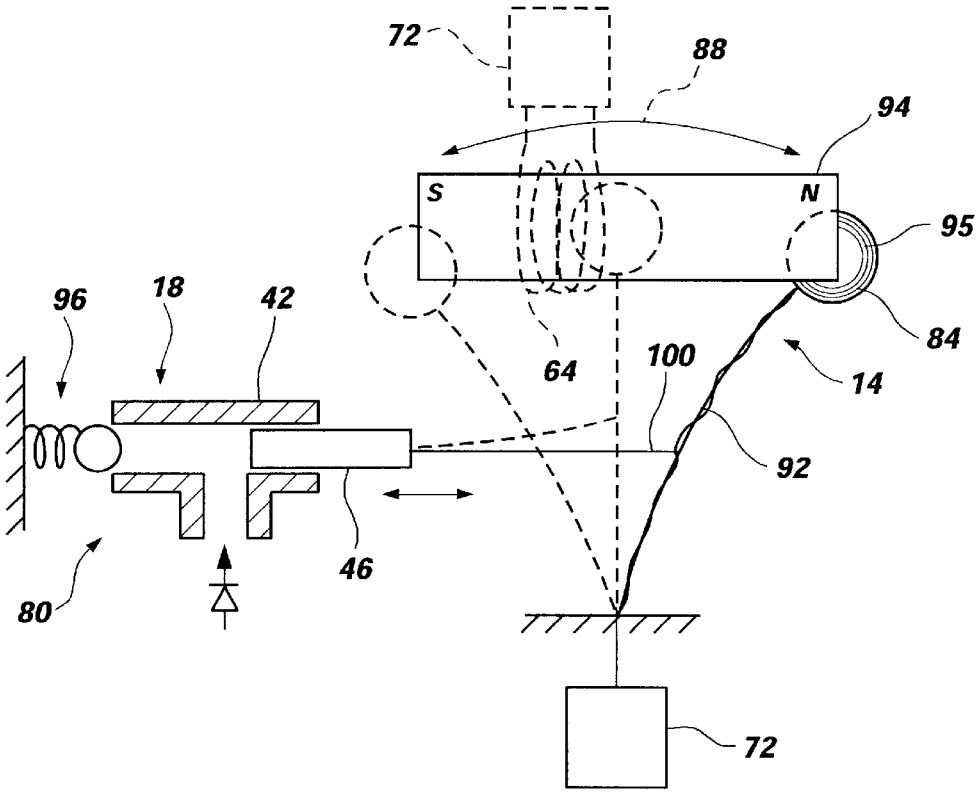
FIG. 2 is a schematic view of a second presently preferred embodiment of a resonator pump system of the present invention.

Referring to FIG. 2, a second presently preferred embodiment of a resonator pump system, indicated generally at 80, has a resonating structure 14 which also includes a moving body, member, or element 84 having a mass m. The resonating structure 14 or body 84 resonates or oscillates back and forth, as indicated by arrow 88, along an arcuate movement path. The resonating structure 14 also includes an energy storing and releasing system, such as a cantilever spring or elongated flexible member 92. The spring 92 is flexible and bends back and forth to store and release energy. Thus, the mass 84 is disposed on an end of the cantilever spring 92 to form the resonating structure 14. As the resonating structure 14 oscillates back and forth in an arcuate fashion, it moves from a position of greatest potential energy (and least kinetic energy) at the far left range of motion (shown in dashed lines), through a position of greatest kinetic energy (and least potential energy) as it moves through its middle range of motion (shown in dashed lines), to a position of greatest potential energy (and least kinetic energy) at the far right range of motion.

Again, an energy source or driver 94, such as an electromagnet, may maintain the resonance of the resonating structure 14, or body 84 and spring 92 Coils 95 may be formed in the body 84 which are acted upon by the magnet, which is held stationary. Alternatively, the magnet may be located in the body, and the coils 64 held stationary. As stated above, a controller 72 can be coupled to the driver 64 or coils 95 to maintain the resonation and/or control the amplitude and frequency of the resonation.

The fluid pump 18 may be similar to the piston pump described above. The fluid pump 18 may include check valves 96, such as ball valves, as shown.

In addition, the piston 46 is coupled to the resonating structure 18, or cantilever spring 92, by a flexible transmission arm 100 rigidly attached to the piston 46 and spring 92, as described in greater detail below.

Figure 3:
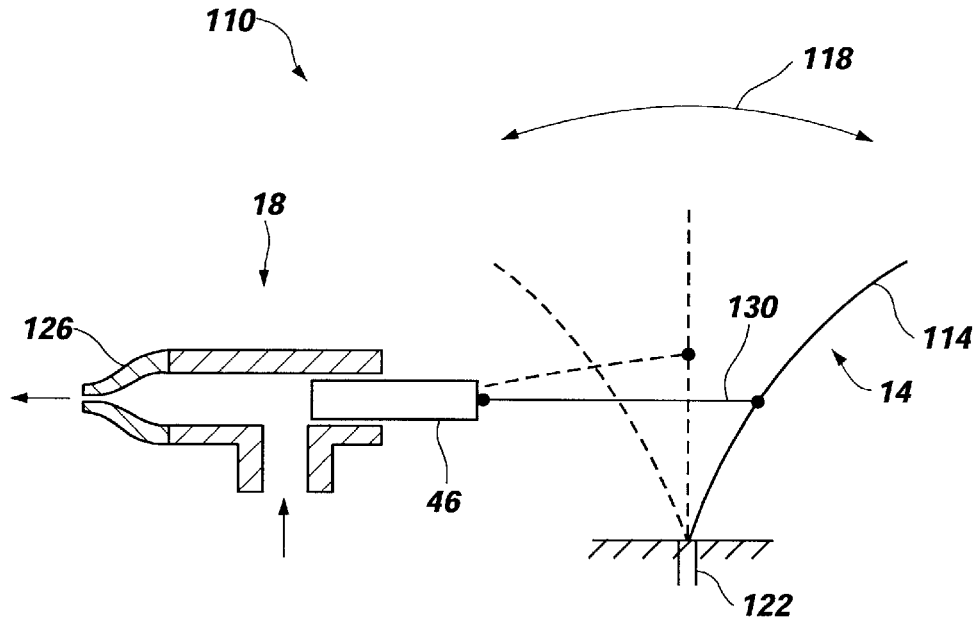
FIG. 3 is a schematic view of a third presently preferred embodiment of a resonator pump system of the present invention.

Referring to FIG. 3, a third presently preferred embodiment of a resonator pump system, indicated generally at 110, has a resonating structure 14 which includes a piezoelectric element 114. The resonating structure 14 or piezoelectric element 114 resonates or oscillates back and forth, as indicated by arrow 118, along an arcuate movement path. The resonating structure 14 or piezoelectric element 114 has layers of material which bend or flex under an applied electric field. The piezoelectric element 114 may be configured to be straight in a natural, un-flexed state, and bend under the applied electric field, such that energy is stored in the bent element 114. Alternatively, the element 114 may be configured to be curved in a natural, un-flexed state, and bend to a straight configuration, or oppositely curved configuration, under the applied electric field. Electrical contacts 122 are coupled to the piezoelectric element 114 for applying an electric field.

The fluid pump 18 may be similar to the piston pump described above. The fluid pump 18 may include check valves 126, such as duckbill valves, as shown.

In addition, the piston 46 is coupled to the resonating structure 18, or piezoelectric element 114, by a rigid transmission arm 130 pivotally attached to the piston 46 and resonating structure 14, as described in greater detail below.

Referring to FIGS. 2 and 3, the fluid pumps 18, or pistons 46, are coupled to the resonating structures 14 by transmission arms 100 (FIG. 2) and 130 (FIG. 3). Referring to FIG. 2, the transmission arm 100 is flexible and rigidly connected to both the piston 46 and the resonating structure 14. Because the resonating structure 14 moves in an arcuate fashion and the arm 100 is rigidly coupled, the flexibility of the arm 100 allows the arm to bend as the resonating structure 14 moves, as indicated by the dashed lines. Thus, as the connection points between the arm 100 and the piston 46 and resonating structure 14 move, the arm 100 bends rather than pivoting about the connection points. The flexible arm 100 may be a thin filament, which may be integrally formed with the piston or cantilever spring, and thus may be more inexpensive to produce.

Referring to FIG. 3, the transmission arm 130 is rigid and pivotally or flexibly connected to both the piston 46 and the resonating structure 14. As the resonating structure 14 moves along the arcuate path, the arm 130 pivots with respect to the piston 46 and resonating structure 14 about its connections. The arm 130 may be pivotally connected by pivot joints. The pivotal joints may present less resistance, and thus present less losses.

Figure 4:
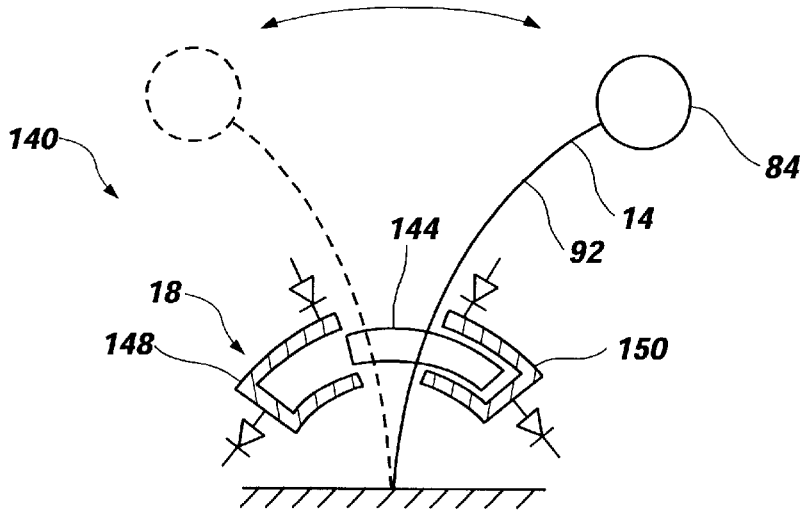
FIG. 4 is a schematic view of a fourth presently preferred embodiment of a resonator pump system of the present invention.

Referring to FIG. 4, a fourth presently preferred embodiment of a resonator pump system, indicated generally at 140, has a resonating structure 14 similar to the mass 84 and cantilever spring 92 discussed above. In addition, the fluid pump 18 may be a piston pump with a piston 144 directly connected to the resonating structure 14 or cantilever spring 92, and extending therefrom in both directions of travel. Furthermore, the fluid pump 18 has cavities 148 and 150 disposed on both sides of the resonating structure 14. The piston 144 has a first portion which extends in one direction into the first cavity 148, and a second portion which extends in the opposite direction into the second cavity 150.

The piston sides and cavities form two pump halves such that the system 140 continually pumps as the resonating structure 14 resonates. As the resonating structure 14 displaces to the right, the first piston portion withdraws from the first cavity 148, drawing fluid into the first cavity 148, while the second piston portion simultaneously forces fluid from the second cavity 150. Similarly, as the resonating structure displaces in the opposite direction, the first piston portion forces fluid from the first cavity 148, while the second piston portion simultaneously draws fluid into the second cavity 150. Thus, the pump system 140 provides a more continuous stream of fluid, or more constant fluid flow.

In addition, the piston 144 and cavities 148 and 150 are arcuate, or have an arcuate cross-section. Thus, the arcuate piston 144 and cavities 148 and 150 conform to the arcuate motion of the resonation structure.

Figure 5:
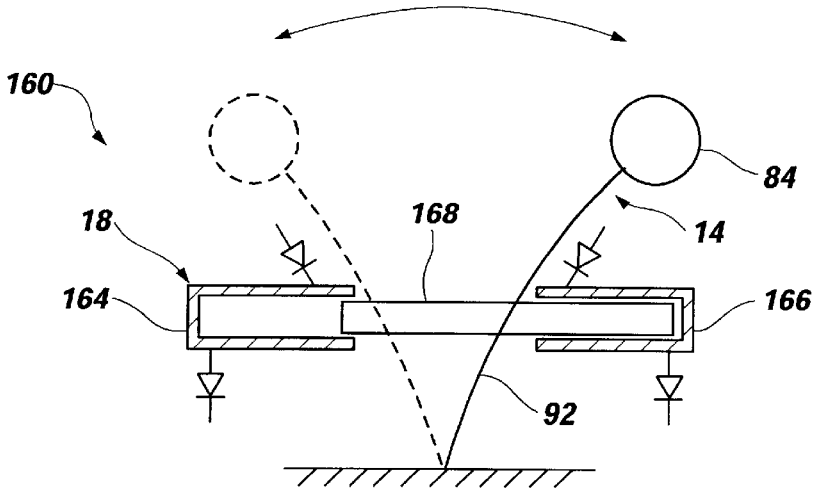
FIG. 5 is a schematic view of a fifth presently preferred embodiment of a resonator pump system of the present invention.

Referring to FIG. 5, a fifth presently preferred embodiment of a resonator pump system, indicated generally at 160, has a resonating structure 14 similar to the mass 84 and cantilever spring 92 discussed above, and a fluid pump 18 with cavities 164 and 166 disposed on both sides of the resonating structure 14. Similarly, a piston 168 is directly connected to the resonating structure 14 or spring 92. The piston 168 and cavities 164 and 166, however, are straight, rather than arcuate. Thus, the piston 168 also is slidably connected to the resonating structure 14 or spring 92 so that the piston 168 slides along a connection point with the spring 92 as the spring 92 move through an arcuate movement path.

Figure 6A:
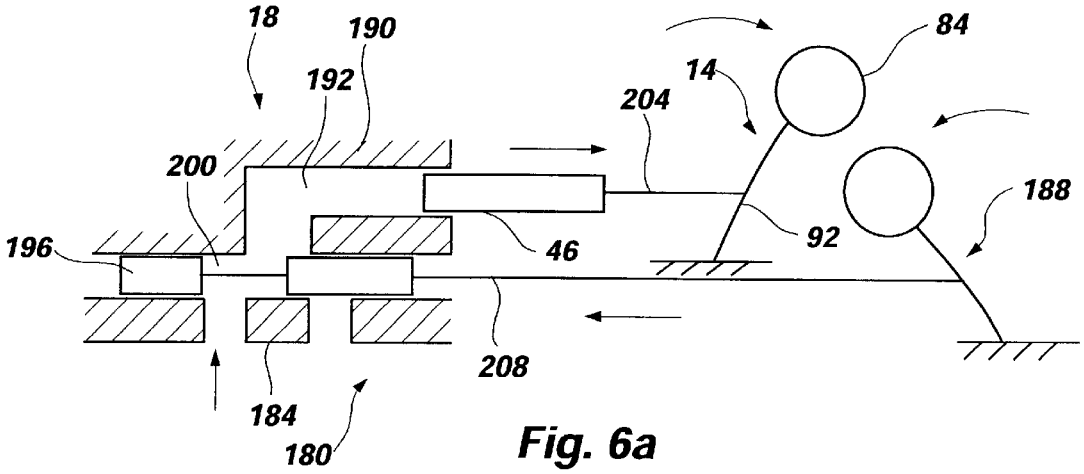
FIGS. 6*a* and 6*b* are schematic views of a sixth presently preferred embodiment of a resonator pump system of the present invention.
Figure 6B:
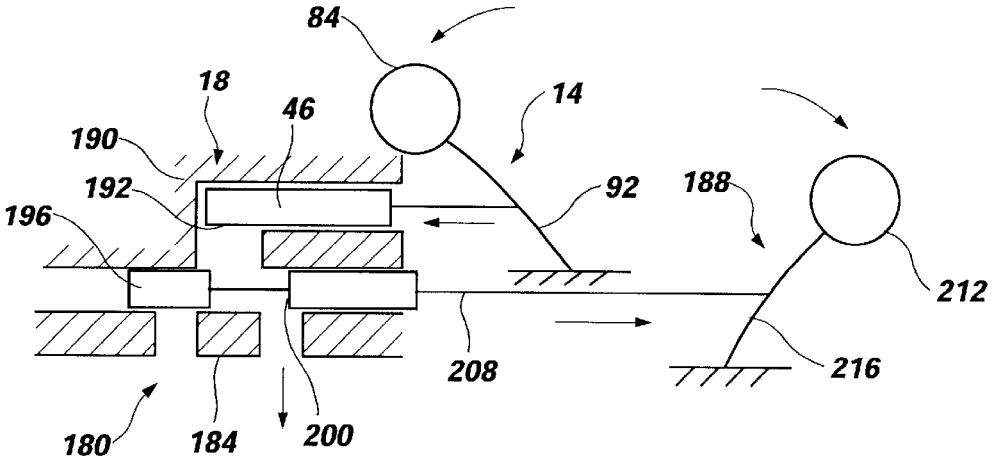

Referring to FIGS. 6*a* and 6*b*, a sixth presently preferred embodiment of a resonator pump system, indicated generally at 180, is shown with a spool valve 184 which also is driven by a second resonating structure 188. Similar to the systems described above, the system 180 has pump 190 with a cavity 192 and a piston 46, and a resonating structure 14 with a mass 84 and a cantilever spring 92. The pump 190 may have a single inlet/outlet opening.

The spool valve 184 is fluidly coupled to the pump 190 with an inlet/outlet opening coupled to the inlet/outlet opening of the pump 190. The spool valve 184 also has a fluid inlet and a fluid outlet. A spool or bobbin 196 is slidably disposed in a cavity in the spool valve 184, and reciprocates back and forth. The spool or bobbin 196 has a fluid passage 200 therein which extends between the inlet/outlet opening, and either the fluid inlet or the fluid outlet. When the spool 196 is located in a first or left position, the fluid passage 200 extends between the inlet/outlet of the pump 190 and valve 184, and the fluid inlet, so that fluid may flow in through the fluid inlet of the valve 184, through the fluid passage 200, through the inlet/outlet openings, and into the cavity 192 of the pump, as shown in FIG. 6*a*. When the spool 196 is in a second or right position, the fluid passage 200 of the spool 196 extends between the inlet/outlet opening of the pump 190 and valve 184, and the fluid outlet, so that fluid may flow out of the cavity 192 of the pump 190, through the inlet/outlet openings, through the fluid passage 200, and out of the fluid outlet.

The piston 46 of the fluid pump 190 is connected by a transmission arm 204 to the first resonating structure 14. Similarly, the spool 196 of the spool valve 184 is connected by a second transmission arm 208 to the second resonating structure 188. The second resonating structure 188 may include a second mass 212 and a second cantilever spring 216. The second resonating structure 188 resonates much like the first resonating structure 14, but 90 degrees out of phase from the first resonating structure 14. Thus, the second resonating structure 188 drives or controls the spool valve 184 to allow fluid into the pump 190 as the piston 46 is withdrawn from the cavity 192 by the first resonating structure 14, as shown in FIG. 6*a*, but displaces the spool 196 to allow fluid out of the pump 190 as the piston 46 drives fluid from the cavity 192, as shown in FIG. 6*b*.

It should be noted that the resonator pump systems described above are intended to be relatively small, and resonate relatively quickly, or at a relatively high frequency. For example, the diameter of the piston or cavity may be between approximately 100 and 1000 $\mu$m (microns), while the resonating structures resonate at a frequency between approximately 200 Hz and 2 KHz. Thus, although the fluid pumps may be relatively small, they are operated at a relatively high frequency to obtain an appreciable flow rate, or a flow rate suitable for certain applications, such as drug pumping or metering.

In addition, it should be noted that the mass or energy of the resonating structure is significantly greater than the mass of fluid in the fluid pump, or the energy required by the fluid pump. Thus, the fluid pump draws a relatively small amount of energy from the resonating structure so that the resonating structure continues to resonate.

It is anticipated that a relatively small pumping unit may be produced which is small enough to be inserted into an IV line; have sufficient flow rate and pressure performance to pump or meter medicaments; and be inexpensively produced to be disposable. For example, a small pumping unit may be inserted into an IV line and have a small resonating structure; a driver to maintain resonance; a battery to power the driver; a controller or microprocessor to control the driver, and thus the resonance and flow rate; a small piston and cavity; and appropriate check valves.

The resonating structure of the present invention may be operated at a constant amplitude and frequency. Such a configuration requires less complicated control, and may be more inexpensive to produce. Alternatively, the controller 72, as discussed in FIG. 1, may be utilized to alter the force exerted by the driver 60, in turn altering the frequency or amplitude of the resonating structure, and thus the flow rate of the fluid pump. Such a configuration allows more control of the pump.

Figure 8:
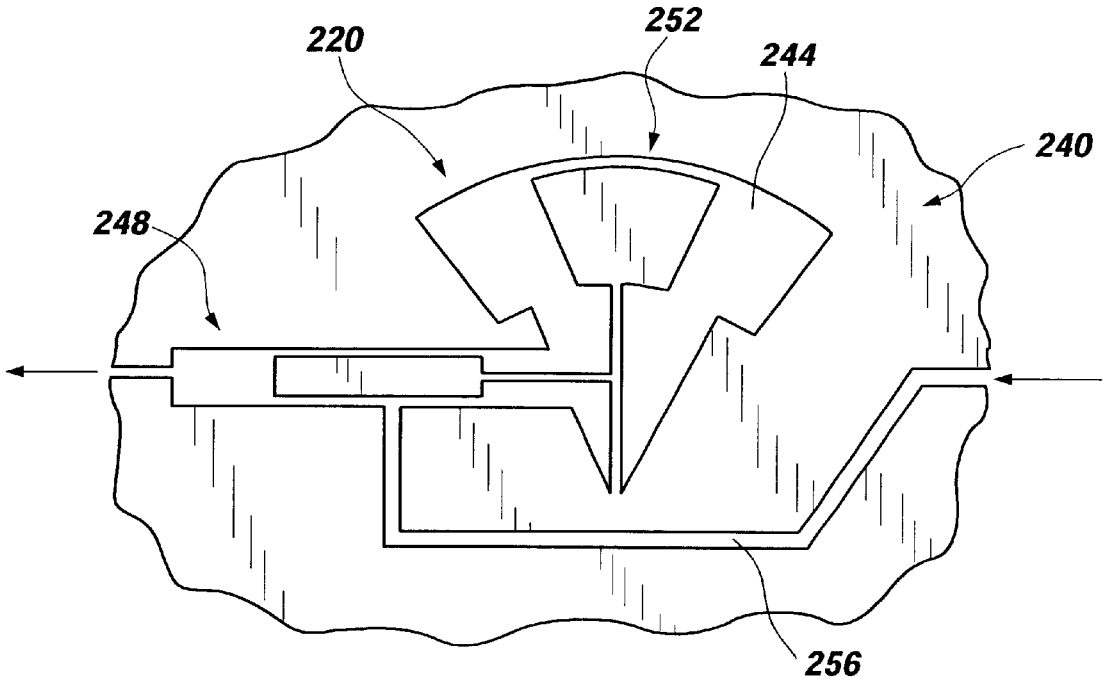
FIGS. 7 and 8 are schematic views of a seventh presently preferred embodiment of a resonator pump system of the present invention.
Figure 7:
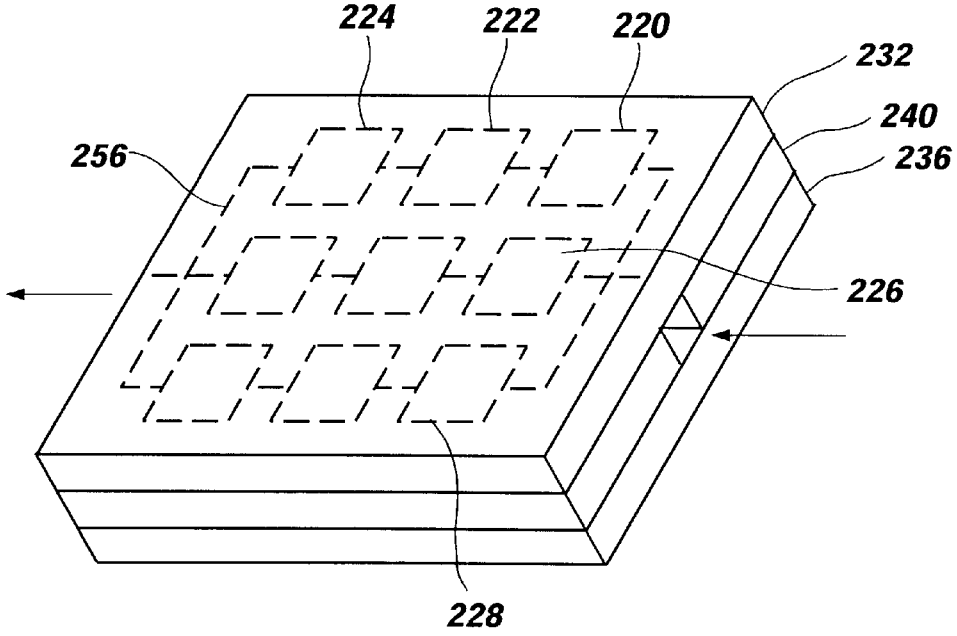

Referring now to FIGS. 7 and 8, the resonator pump system of the present invention may be micro-fabricated, or lithographed into layers of material, to form one or more pumps and/or resonating structures. Thus, the resonator pump system may include one, or a plurality of pump systems, disposed in an array or matrix. Several pump systems, indicated by the dashed boxes 220 in FIG. 7, may be formed by the layers. Several pump systems 220 may be disposed in series, indicated by dashed boxes 220, 222 and 224, to increase pressure. In addition, several pump systems 220 may be disposed in parallel, indicated by dashed boxes 220, 226 and 228, to increase flow rate. Additionally, several pump systems may be disposed in series and parallel, and independently controlled, to obtain the desired fluid flow characteristics, or rate and pressure.

The pump systems may include first and second layers 232 and 236 sandwiching a third layer 240. Referring to FIG. 8, the third layer 240 may be patterned with openings, indicated generally at 244, to form a fluid pump 248 and resonating structure 252. In addition, the third layer 240 may be patterned to form fluid passageways or channels 256. Each pump 248 and resonating structure 252 form a pump system 220. As shown in FIG. 7, a number of pump systems 220 may be patterned into the third layer 240, and sandwiched between the first and second layers 232 and 236, to form the cavity of the pump 248 (FIG. 8) and fluid passageways 256 (FIG. 8). Such a system may be utilized to control the flow characteristics, such as flow rate and pressure.

Additional layers of electrically conductive material may be patterned on the layers in order to apply an electrical field to the resonant structure 252 of the third layer 240.

Although the fluid pumps and resonating structures described above have been illustrated and described as being mechanically coupled by transmission arms, it will be appreciated that the coupling may be accomplished by any appropriate means, including for example, magnetically, etc.

Similarly, although the resonating structures have been described as being operatively engaged by magnetic drivers, it will be appreciated that the resonance of the resonating structures may be maintained by any appropriate means, including for example, mechanical engagement, etc.

The pump systems described above physically remove energy from a mechanically resonating structure in order to pump a fluid.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A resonator pump system comprising:

a resonating structure configured for resonating movement;

an energy source operatively coupled to the resonating structure for maintaining resonance; and a fluid pump coupled to and driven by the resonating structure.

2. The resonator pump system of claim 1, wherein the resonating structure resonates between approximately 200 Hz to 2 KHz.

3. The resonator pump system of claim 1 wherein the fluid pump has a diameter between approximately 100 to 1000 microns.

4. The resonator pump system of claim 1, wherein the resonating structure has a mass substantially greater than a mass of fluid in the fluid pump.

5. The resonator pump system of claim 1, wherein the resonating structure has kinetic energy substantially greater than an amount of energy used to drive the fluid pump.

6. The resonator pump system of claim 1, wherein the resonating structure resonates at a constant amplitude.

7. The resonator pump system of claim 1, wherein the resonating structure resonates at a constant frequency.

8. The resonator pump system of claim 1, further comprising:

a sensor configured for sensing the resonation of the resonating structure and producing a sensor signal; and wherein the energy source includes a driver responsive to the sensor signal for applying a force to the resonating structure to maintain the resonance.

9. The resonator pump system of claim 8, further comprising:

a controller coupled to the driver and the sensor for controlling the amplitude or frequency of the resonating structure.

10. The resonator pump system of claim 1, wherein the energy source is a magnet.

11. The resonator pump system of claim 1, wherein the fluid pump is mechanically coupled to a moving portion of the resonating structure by a transmission arm coupled to and between the resonating structure and the fluid pump.

12. The resonator pump system of claim 1, wherein the fluid pump is coupled to the resonating structure by a flexible arm rigidly coupled to both the pump and the structure.

13. The resonator pump system of claim 1, wherein the fluid pump is coupled to the resonating structure by a rigid arm pivotally coupled to both the pump and the structure.

14. The resonator pump system of claim 1, wherein the resonating structure includes:

a base;

a spring element coupled at one end to the base; and a mass, coupled to another end of the spring element, and configured for linear motion with respect to the base.

15. The resonator pump system of claim 1, wherein the resonating structure includes:

a base;

an elongated and flexible spring element with one end coupled to the base; and a mass, coupled to another end of the flexible spring element, and configured for arcuate motion with respect to the base.

16. The resonator pump system of claim 1, wherein the resonating structure includes:

a base; and a piezoelectric element, coupled to the base, and configured for bending under an applied electric field.

17. The resonator pump system of claim 1, wherein the fluid pump includes:

a cavity having a fluid inlet and a fluid outlet; and a piston, movably disposed within the cavity and operatively coupled to the resonating structure.

18. The resonator pump system of claim 1, wherein the fluid pump comprises first and second fluid pumps including:

a first cavity disposed on one side of the resonating structure; and a first piston, movably disposed within the first cavity and operatively coupled to the resonating structure; and a second cavity disposed on another side of the resonating structure; and a second piston, movably disposed within the second cavity and operatively coupled to the resonating structure, such that the first and second fluid pumps alternately pump to achieve a substantially constant fluid flow.

19. The resonator pump system of claim 1, wherein the resonating structure includes:

an elongated and flexible spring element with one end coupled to a base; and a mass, coupled to another end of the flexible spring element, and configured for arcuate motion; and wherein the fluid pump includes:

a cavity disposed proximate the spring element; and a piston directly connected to the spring element.

20. The resonator pump system of claim 1, wherein the fluid pump further includes a fluid inlet and a fluid outlet, each having a valve selected from the group consisting of duckbill check valves, ball check valves, and spool valves.

21. The resonator pump system of claim 1, further comprising:

a spool valve fluidly coupled to the fluid pump; and a second resonating structure, coupled to the spool valve, and configured for resonating 90 degrees out of phase from the first resonating structure.

22. The resonator pump system of claim 1, further comprising:

a plurality of resonating structures coupled to a plurality of fluid pumps, the fluid pumps being coupled in series to increase pressure.

23. The resonator pump system of claim 1, further comprising:

a plurality of resonating structures coupled to a plurality of fluid pumps, the fluid pumps being coupled in parallel to increase flow.

24. The resonator pump system of claim 1, further comprising:

a first plurality of resonating structures coupled to a first plurality of fluid pumps, the first plurality of fluid pumps being coupled in series to increase pressure; and a second plurality of resonating structures coupled to a second plurality of fluid pumps, the second plurality of fluid pumps being coupled in parallel to increase flow.

25. The resonator pump system of claim 24, wherein the plurality of resonating structures and fluid pumps are individually operable to control the pressure and flow.

26. The resonator pump system of claim 1, wherein both the resonating structure and fluid pump comprise:

first and second flat layers; and a third layer, sandwiched between the first and second layers, and being patterned with openings to form both the resonating structure and the fluid pump.

27. The resonator pump system of claim 1, wherein the fluid pump and resonating structure are inserted into an IV line.

28. A resonator pump system comprising:

a resonating structure including a resonating mass configured for oscillating motion, and an energy storing and releasing system coupled-to the resonating mass;

an energy source, coupled to the resonating structure, for maintaining the oscillating motion of the mass;

a transmission arm, coupled to a moving portion of the resonating structure, for coupling the oscillating motion of the resonating mass;

a fluid pump, driven by the resonating structure, and including a cavity and a piston movably disposed in the cavity and operatively coupled to the transmission arm.

29. A resonator pump system comprising:

a resonating structure configured for oscillating motion;

a driver, operatively engaging the resonating structure, for applying a force to the resonating structure to maintain the oscillating motion;

a transmission arm operatively coupled to a moving portion of the reciprocating structure;

a cavity having a fluid inlet and a fluid outlet; and a piston, movably disposed within the cavity and operatively coupled to the transmission arm.

30. A resonator pump system comprising:

first and second layers;

a third layer, sandwiched between the first and second layers, and patterned with openings to form:

a resonating structure, attached to the third layer, and configured for resonating;

a fluid pump including a cavity and a piston movably disposed in the cavity; and a transmission arm coupled to and extending between the resonating structure and the piston.

31. A resonator pump system comprising:

a first resonating structure configured for resonating;

a fluid pump coupled to and driven by the first resonating structure;

a second resonating structure configured for resonating 90 degrees out of phase from the first resonating structure;

a spool valve, fluidly coupled to the fluid pump, and operatively coupled to and driven by the second resonating structure; and at least one an energy source operatively coupled to the resonating structures for maintaining resonance.

* * * * *

UNITED STATES PATENT AND TRADEMARK OFFICE

CERTIFICATE OF CORRECTION

PATENT NO. : 6,425,740 B1 
DATED : July 30, 2002
INVENTOR(S) : Stephen C. Jacobsen and Clark C. Davis It is certified that error appears in the above-identified patent and that said Letters Patent is hereby corrected as shown below:

Column 1,
Line 53, “includes” should be replaced with -- include --.

Column 4,
Line 44, “resonating structure 18” should be replaced with -- resonating structure 14 --.
Lines 61 and 62, “resonating structure 18” should be replaced with -- resonating structure 14 --.

Column 5,
Line 24, “coils 64” should be replaced with -- coils 95 --.

Column 6,
Line 56, “move” should be replaced with -- moves --.

Column 11,
Line 4, “-” should be deleted.

Column 12,
Line 20, “an” should be deleted.

Signed and Sealed this

Ninth Day of December, 2003

JAMES E. ROGAN
*Director of the United States Patent and Trademark Office*